US010838448B1

(12) United States Patent
Yadala et al.

(10) Patent No.: US 10,838,448 B1
(45) Date of Patent: Nov. 17, 2020

(54) BANDGAP REFERENCE GENERATION CIRCUIT

(71) Applicant: SanDisk Technologies LLC, Addison, TX (US)

(72) Inventors: Sridhar Yadala, Bengaluru (IN); Sivakumar Grandhi, Bengaluru (IN); Nittala Venkata Satya Somanadh Kumar, Bengaluru (IN)

(73) Assignee: SanDisk Technologies LLC, Addison, TX (US)

( * ) Notice: Subject to any disclaimer, the term of this patent is extended or adjusted under 35 U.S.C. 154(b) by 0 days.

(21) Appl. No.: 16/453,702

(22) Filed: Jun. 26, 2019

(51) Int. Cl.
*G05F 3/00* (2006.01)
*G05F 3/26* (2006.01)

(52) U.S. Cl.
CPC ..... *G05F 3/26* (2013.01)

(58) Field of Classification Search
CPC ..... G05F 3/26; G05F 3/10; G05F 3/16; G05F 3/18; G05F 3/185; G05F 3/20
See application file for complete search history.

(56) References Cited

U.S. PATENT DOCUMENTS

2009/0051341 A1* 2/2009 Chang ..... G05F 3/30 323/313
2009/0146730 A1* 6/2009 Chen ..... G05F 3/30 327/539
2017/0131736 A1* 5/2017 Acar ..... G05F 3/267

* cited by examiner

*Primary Examiner* — Adolf D Berhane
*Assistant Examiner* — Afework S Demisse
(74) *Attorney, Agent, or Firm* — Vierra Magen Marcus LLP

(57) ABSTRACT

A bandgap reference generation circuit in an integrated circuit (IC) and method for generating a bandgap reference voltage are disclosed. The bandgap reference generation circuit includes a first proportional to absolute temperature (PTAT) current generation section for generating a PTAT current component, a current circuit configured to generate a trimmed PTAT current component substantially invariant of sheet resistance of at least one resistor in the current circuit, and a complementary to absolute temperature (CTAT) current generation section including a diode on which the trimmed PTAT current component is fed to generate a CTAT current component. A combination of the PTAT and CTAT current components generate the bandgap reference voltage.

20 Claims, 11 Drawing Sheets

400

BANDGAP REFERENCE GENERATION CIRCUIT

BACKGROUND

Electronic circuits often require a reliable source for a reference voltage. For instance, the reference voltage is used in a variety of electronic circuits based applications such as temperature sensors, analog to digital converters, buck and boost converters, and power supplies. The accuracy of the reference voltage is one aspect optimized for in these various applications. One commonly used voltage reference circuit for generating the reference voltage is a bandgap voltage reference circuit. In the bandgap voltage reference circuit, a bandgap reference voltage is generated by a combination of a voltage proportional to absolute temperature ($V_{PTAT}$) and a voltage complementary to absolute temperature ($V_{CTAT}$) to cancel out the effects of temperature variations. As the bandgap reference circuit is aimed to generate temperature-independent bandgap reference voltage, it is important to minimize or eliminate the process, voltage and temperature related variations in generation of the bandgap reference voltage.

SUMMARY

This summary is provided to introduce a selection of concepts in a simplified form that are further described below in the detailed description. This summary is not intended to identify key or essential features of the claimed subject matter, nor is it intended to be used as an aid in determining the scope of the claimed subject matter.

In an embodiment, a bandgap reference generation circuit in an integrated IC is disclosed. The bandgap reference generation circuit generates a reference voltage independent of on-chip temperature of the IC. The bandgap reference generation circuit includes a first proportional to absolute temperature (PTAT) current generation section comprising a PTAT resistor and a current mirror circuit for generating a PTAT current component. The bandgap reference generation circuit includes a current circuit configured to generate a trimmed PTAT current component. The trimmed PTAT current component is substantially invariant of sheet resistance of a second resistor in the current circuit. The bandgap reference generation circuit includes a complementary to absolute temperature (CTAT) current generation section connected between the current circuit and a ground terminal. The CTAT current generation section includes a diode on which the trimmed PTAT current component is fed to generate a CTAT current component. A combination of the trimmed PTAT current component and the CTAT current component generate the reference voltage at an output node of the bandgap reference generation circuit.

In another embodiment, a current circuit for use in a bandgap reference generation circuit in an integrated circuit (IC) is disclosed. The current circuit comprises a proportional to absolute temperature (PTAT) current generation section for generating a trimmed PTAT current component. The trimmed PTAT current component is substantially invariant of sheet resistance of a PTAT resistor The PTAT current generation section is different than another PTAT current generation section used for generating a PTAT current component in the bandgap reference generation circuit. Further, the trimmed PTAT current component is used to generate a complementary to absolute temperature (CTAT) current component in the bandgap reference generation circuit.

In another embodiment, a method performed by a bandgap reference generation circuit for generating a bandgap reference voltage is disclosed. The method includes generating a proportional to absolute temperature (PTAT) current component by a first PTAT current generation section comprising a first resistor and a first current mirror circuit. The method includes generating a trimmed PTAT current component substantially invariant of sheet resistance of a PTAT resistor used for generating the PTAT current component. The method includes generating a complementary to absolute temperature (CTAT) current component by feeding the trimmed PTAT current component on a CTAT element. The method includes generating the bandgap reference voltage based on a combination of the PTAT current component and the CTAT current component

BRIEF DESCRIPTION OF THE DRAWINGS

A more particular description is included below with reference to specific embodiments illustrated in the appended drawings. Understanding that these drawings depict only certain embodiments of the disclosure and are not therefore to be considered to be limiting of its scope, the disclosure is described and explained with additional specificity and detail through the use of the accompanying drawings, in which.

DETAILED DESCRIPTION

In the following detailed description, numerous specific details are set forth in order to provide a thorough understanding of the present technology. However, the present technology may be practiced without these specific details. In other instances, well-known methods, procedures, components, and circuits have not been described in detail so as to not unnecessarily obscure aspects of the exemplary embodiments presented herein. Moreover, it is noted that structures and devices are shown in block diagram form in order to avoid obscuring the disclosure.

Reference in this specification to "one embodiment" or "an embodiment" means that a particular feature, structure, or characteristic described in connection with the embodiment is included in at least one embodiment of the disclosure. The appearance of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various parameters are described that may be parameters for some embodiments but not for other embodiments.

The term "trimming" of a component used throughout the description refers to adjusting a net value of the component so as to achieve a desired result, and the term "trimmable component" refers to a component whose value can be modified or adjusted in response to an input. For instance, a "trimmable resistor" may be a resistor comprising a plurality of resistors from which a certain number of resistors can be selected to contribute to the net resistance of the trimmable resistor based on the input. Similarly, a "trimmable resistor" may be a transistor composed of a plurality of transistors from which a certain number of transistors can be selected to contribute to the net channel width of the trimmable transistor. Further, "trimmed current" at a node refers to an adjusted current by trimming one or more of trimmable resistors and/or trimmable transistors electronically coupled to the node.

Figure 1:
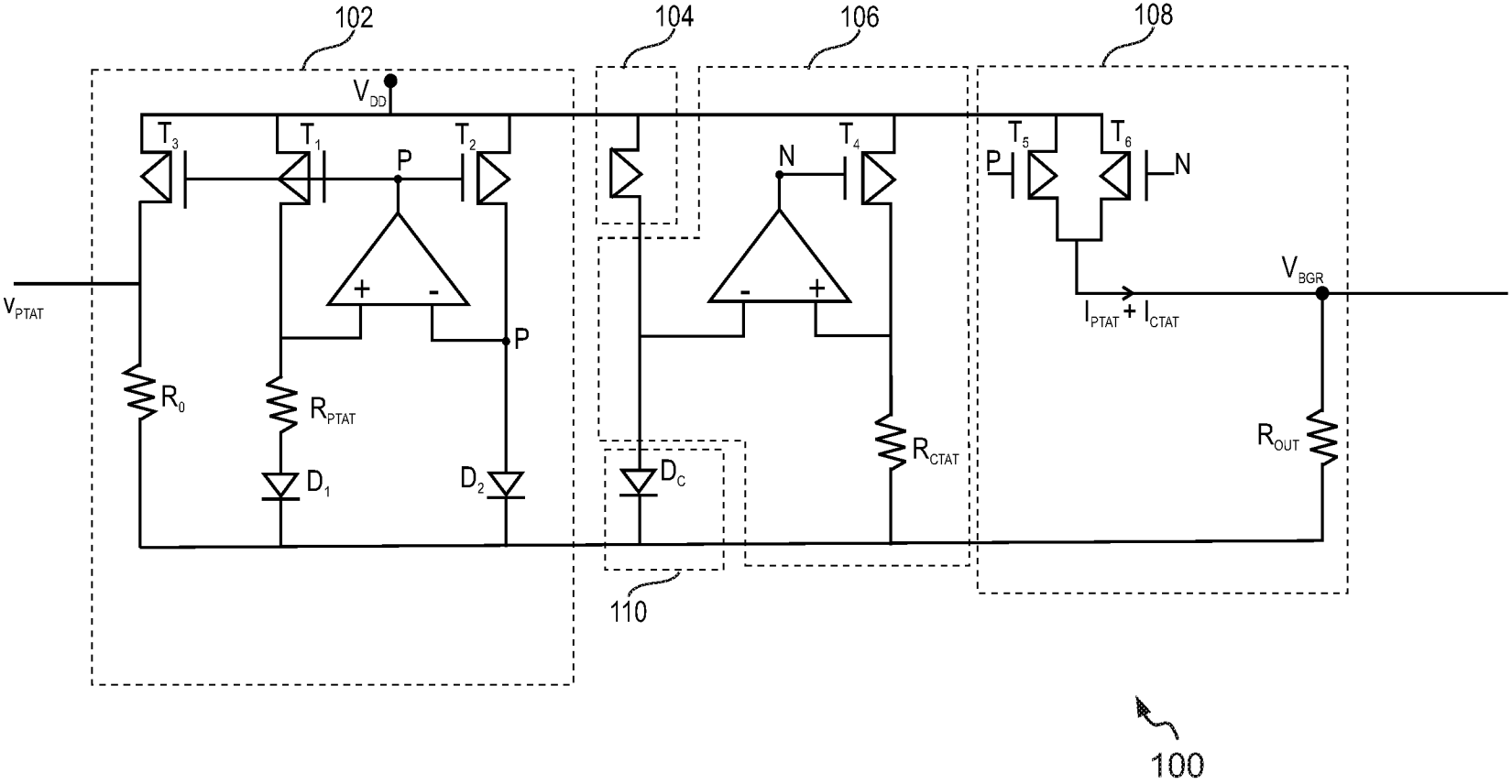
FIG. 1 (PRIOR ART)
FIG. 1 is a circuit diagram representation of a conventional bandgap reference circuit.

One commonly used voltage reference circuit is a bandgap reference circuit 100, as illustrated in FIG. 1 (prior art). In order to neutralize the effect of on-chip temperature variations, the bandgap reference circuit 100 generates the reference voltage based on a combination of a proportional to absolute temperature (PTAT) current element and a complementary to absolute temperature (CTAT) current element. The bandgap reference circuit 100 includes a PTAT current circuit 102, a transistor 104, a CTAT current circuit 106 and an output circuit 108. The PTAT current circuit 102 generates a PTAT current and a PTAT voltage (see, P). The PTAT voltage is fed to the CTAT current circuit 106 via the transistor 104. The CTAT current circuit 106 generates a CTAT current and a CTAT voltage (see, N) based on the PTAT current received via the transistor 104 into a diode 110. In this circuit 100, the output circuit 108 provides the output voltage reference ($V_{BGR}$), which is proportional to the sum of the PTAT voltage and the CTAT voltage and depends upon the value of $R_{OUT}$ resistor.

Figure 2:
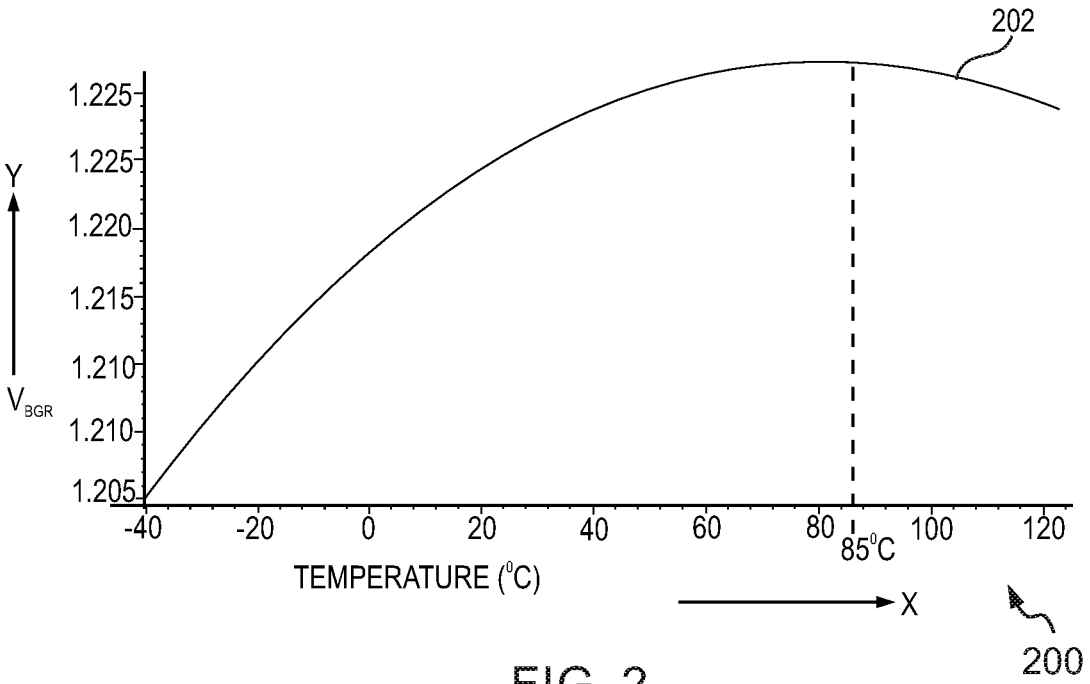
FIG. 2 exemplarily represents variation of bandgap reference voltage over absolute temperature for the circuit of FIG. 1.

The PTAT voltage is proportional to the absolute temperature. The voltage across the diode 110, which is fed with the PTAT current, is the CTAT voltage component that decreases with an increase in the absolute temperature. The bandgap reference circuit 100 is designed to generate a bandgap reference voltage ($V_{BGR}$) proportional to the bandgap of silicon, which is ideally invariant of the on-chip temperature. However, $V_{BGR}$ has a curvature due to the non-linear relationship between base to emitter voltage ($V_{BE}$) of the transistors present in the bandgap voltage reference circuit 100 and the on-chip temperature. An exemplary curvature of $V_{BGR}$ is illustrated in FIG. 2, in which a curvature 202 is shown along the X-axis represented as absolute temperature and the Y-axis represented as $V_{BGR}$. As shown in FIG. 2, the curvature 202 has a zero temperature coefficient (TCO) at 85° C. (also referred to as high-temperature (HT) for the purposes of the present disclosure). In an example scenario, the bandgap reference circuit 100 may be used in a temperature sensing circuit, in which a reference voltage $V_{REF}$ (generated by the circuit 100) is compared with a $V_{PTAT}$ voltage, which is proportional to the absolute temperature, to determine the temperature. In this example, $V_{REF}$ is set at 85° C. for zero TCO and minimum curvature, and is used for comparison with the $V_{PTAT}$ for measuring the temperature.

Figure 3:
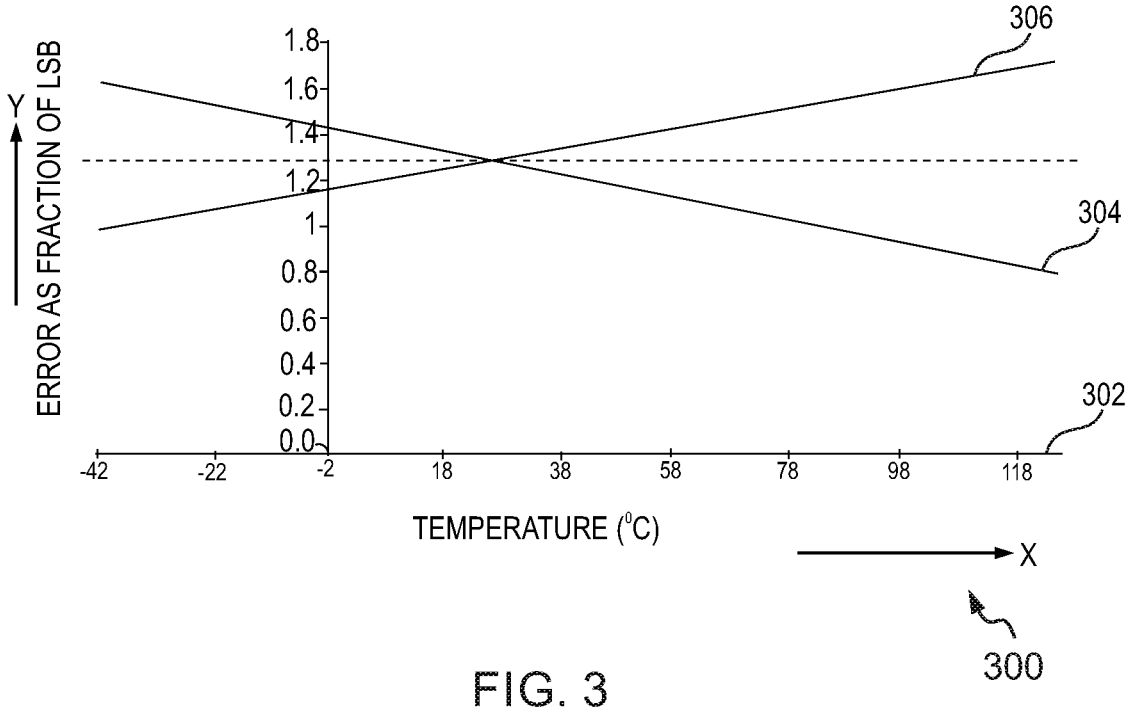
FIG. 3 exemplarily represents errors in a voltage proportional to absolute temperature ($V_{PTAT}$) generated by the circuit of FIG. 1 due to trimming of the $V_{PTAT}$ at two different temperatures (e.g., a high-temperature and a low-temperature) for the circuit of FIG. 1.
Figure 4:
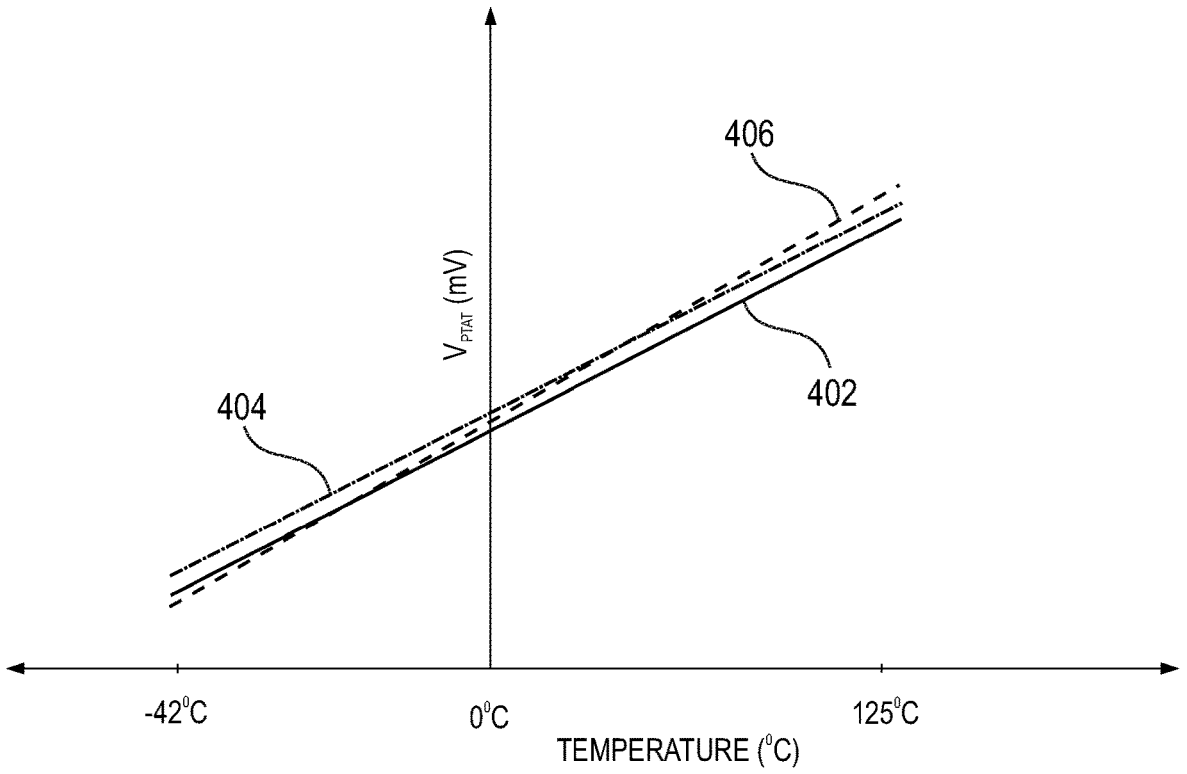
FIG. 4 exemplarily represents plots of slopes of $V_{PTAT}$ with respect to the absolute temperature due to trimming of the $V_{PTAT}$ at two different temperatures and an ideal slope of $V_{PTAT}$ for the circuit of FIG. 1.

In the above example of temperature sensing circuit utilizing the bandgap reference circuit 100, $V_{REF}$ is set at 85° C. for zero TCO and minimum curvature. In this example, for the temperature sensing circuit to be accurate, the value of $V_{PTAT}$ is adjusted (i.e. trimmed) such that at 85° C., $V_{PTAT}$ matches with the $V_{REF}$. However, in process of trimming, if $V_{PTAT}$ is trimmed at 85° C. with the desired accuracy, the residual offset at 85° C. introduces more error (plus/minus) at low-temperature (e.g., at LT −42° C.) as temperature gradient is more on the lower values of temperature (e.g., from 85° C. to −42° C.) and less error (plus/minus) at the higher values of temperature (e.g., from 85° C. to 125° C.). Such occurrences of errors are shown in FIGS. 3 and 4. For instance, FIG. 3 represents a plot of errors introduced by LT and HT trimming as a fraction of least significant bits (e.g., $V_{REF}$ <63:0> represented by 6 bits) with respect to variations in temperature from −42° C. to 125° C. An ideal $V_{PTAT}$ error is represented by a line 302, which has a zero error. However, as illustrated in FIG. 3, trimming of $V_{PTAT}$ at HT (e.g., 85° C.) shifts the $V_{PTAT}$ at other temperatures and, and such shift is more pronounced at lower temperatures (see, line 304). Similarly, as shown by a line 306, trimming at low-temperature LT (e.g., −42° C.) introduces errors more on the higher temperatures. FIG. 4 represents plots of slopes of $V_{PTAT}$ with respect to temperature for different trimming scenarios. In an ideal case, $V_{PTAT}$ should rise with temperature linearly between a temperature range of −42° C. to 125° C. in a step manner (as shown by a line 402). However, when the HT trimming or LT trimming is performed, corresponding slopes (represented by lines 404 and 406, respectively) deviate from the ideal $V_{PTAT}$ slope (represented by line 402), which indicates errors in the measurement of temperature or any other parameter in an application of the bandgap reference circuit 100.

Referring back to the bandgap reference circuit 100, current $I_{PTAT}$ is generated as depending on the $R_{PTAT}$, and this current is dumped on a diode $D_C$ which has a $V_{BE}$ voltage drop across two nodes of the diode $D_C$. It is noted that $V_{BE}$ is a CTAT component with a temperature coefficient of ~−2 mV/C and generates a CTAT current component. The PTAT current component and the CTAT current component are mixed in proper proportion at 85° C. to get a zero TCO. Below are the expression for $V_{BGR}$ and $V_{PTAT}$:

$$V_{BGR}/V_{REF}=(V_T \ln(n)/R_{PTAT}=V_{BE}/R_{CTAT})*R_{VBGR}/R_{DAC} \quad \text{Eq(1)}$$

$$V_{PTAT}=(V_T \ln(n)/R_{PTAT})*R_0 \quad \text{Eq(2)}$$

where $V_{BGR}$ is a bandgap reference voltage, $V_{REF}$ is a reference voltage, $V_T$ is a voltage with a linear positive temperature correlation, $R_{VBGR}$ is a resistor along which $V_{BGR}$ is measured at output (represented by $R_{OUT}$) and $R_{DAC}$ is a resistor through which reference voltage is fed to an analog to digital converter (ADC) for on-chip temperature calculation or for any other suitable application.

It is noted that $R_{PTAT}$ and $R_{CTAT}$ are polysilicon resistors which have sheet resistance variations across process. In integrated circuits such as NAND based memory systems, sheet resistance of $R_{PTAT}$ may by ±40%. Such variations of $R_{PTAT}$ causes variations in $I_{PTAT}$, and as the $I_{PTAT}$ is fed to the diode $D_C$, it causes $V_{BE}$ drift. $V_{BE}$ drift alters the $I_{CTAT}$ and causes drift in DC values as well as in the curvature of $V_{BGR}$.

Based on the foregoing, there are two main challenges in the bandgap reference circuit 100, as it needs LT trimming in addition to the HT trimming, and there is an effect of the variations of the sheet resistance of resistors (e.g., $R_{PTAT}$) of the bandgap reference circuit 100. The cost of trimming at both temperatures increases significantly as more parameters are needed to support both of the LT and HT trimming, which is a digital overhead for ICs such as NAND based memory chips. Hence, to address these challenges, embodiments of the present disclosure provide a current circuit for a bandgap reference circuit. The current circuit is configured to generate a PTAT current component that is trimmed for a single temperature (i.e. HT), where the trimmed PTAT current component is independent of process variations, and the trimmed PTAT current component is fed to a diode in a CTAT loop of the bandgap reference circuit. As the trimmed PTAT current component is provided to the CTAT loop, the CTAT current component provided by the CTAT loop is invariant of sheet resistance variations of the PTAT resistor. Various embodiments of present disclosure, instead of trimming $R_{PTAT}$ of the bandgap reference circuit, utilize additional PTAT loop to generate a trimmed PTAT current component which is invariant of process variations, for example, the sheet resistance variations of resistors.

Figure 5:
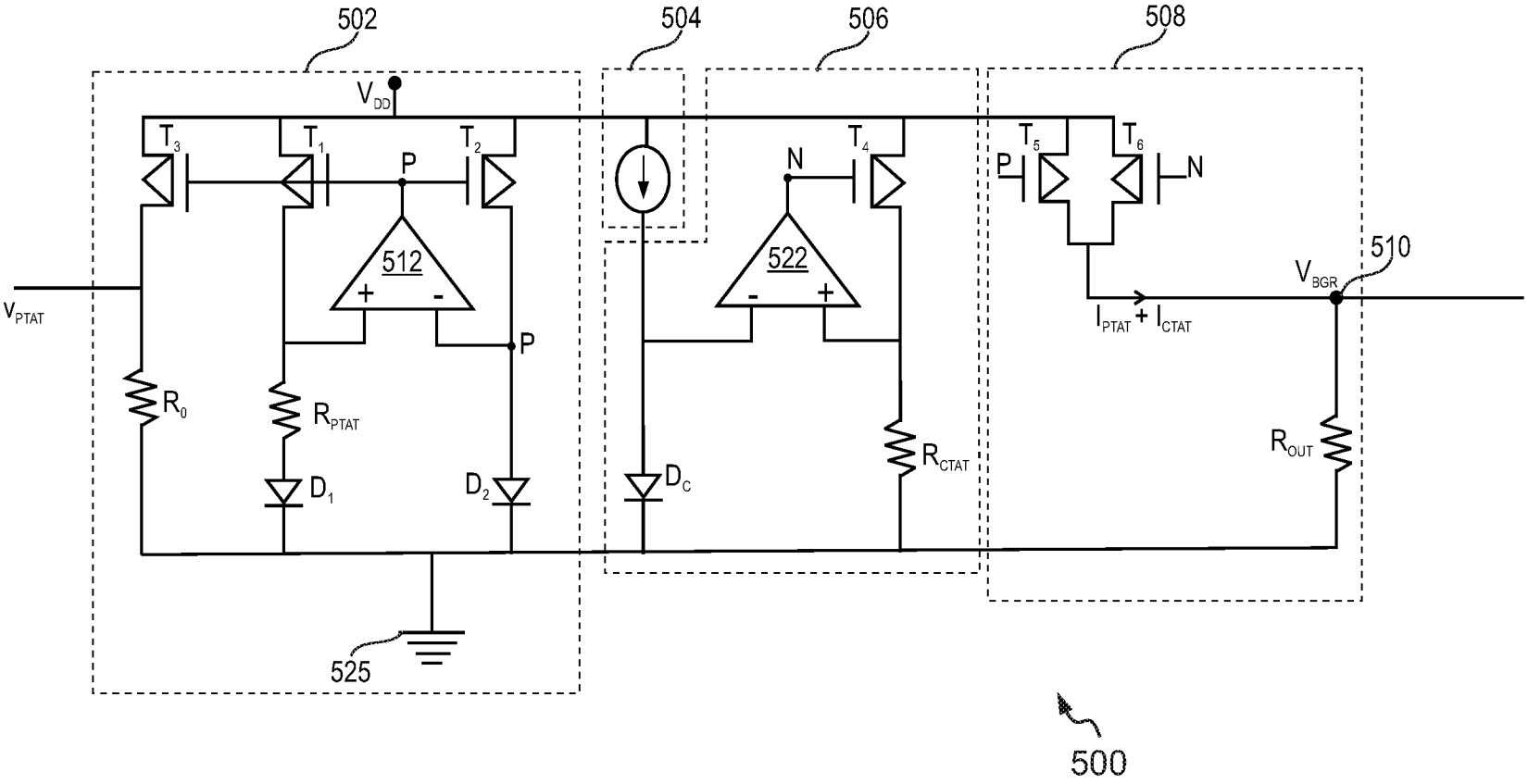
FIG. 5 illustrates a circuit diagram of a bandgap reference generation circuit, in accordance with an embodiment of the present disclosure.

Referring now to FIG. 5, a circuit diagram of a bandgap reference generation circuit 500 is illustrated, in accordance with an embodiment of the present disclosure. In the depicted embodiment, the bandgap reference generation circuit 500 includes a first PTAT current generation section 502, a current circuit 504, a CTAT current generation section 506, and an output section 508 providing $V_{REF}$ (or $V_{BGR}$) at an output node 510. The bandgap reference generation circuit 500 generates a PTAT current component that is proportional to the absolute temperature and a CTAT current component that is negatively proportional to the absolute temperature. At the output node 510, both these components are added to generate a reference voltage i.e. $V_{REF}$ (or $V_{BGR}$).

The PTAT current generation section 502 generates a PTAT current component proportional to the absolute temperature. The PTAT current generation section 502 includes a current mirror circuit exemplarily represented as formed by P-MOS transistors T1, T2 and an operational amplifier 512, and biasing elements such as a transistor T3 and a resistor R0. An equal current flows in the branch of diode D1 and the resistor $R_{PTAT}$ and in the branch of diode D2, and a voltage proportional to absolute temperature is generated across the resistor $R_{PTAT}$. An output current from the operational amplifier 512 is provided to the current circuit 504, which is $I'_{PTAT}$. The current circuit 504 is configured to generate the trimmed $I_{PTAT}$ i.e. $I_{PTAT}$ that is independent of sheet resistance variation of the resistor $R_{PTAT}$.

In the depicted embodiment of FIG. 5, a CTAT current component is generated by the CTAT current generation section 506 which includes an operational amplifier (op-amp) 522, a transistor T4, a diode $D_C$ and a resistor (see, $R_{CTAT}$). The CTAT current component is generated across the CTAT element i.e. the diode $D_C$, and is provided to the output section 508 from an output of the op-amp 522.

The output section 508 includes a current mirror circuit including two transistors such as a PMOS transistor T5 and a PMOS transistor T6. The output section 508 receives a combination of $I_{PTAT}$ and $I_{CTAT}$ and a reference voltage ($V_{BGR}$) is provided at the output node 510 of the output section 508. For example, as shown in the illustrated representation of FIG. 5, a PTAT voltage bias ($V_{PTAT}$) is applied at the gate of the transistor T5 and a CTAT voltage bias ($V_{CTAT}$) is applied at the gate of the transistor T6.

The current circuit 504 is configured to provide the $I_{PTAT}$ to the diode $D_C$ such that the $I_{PTAT}$ is not affected by process mostly dominated by the sheet resistance variation of the resistance '$R_{PTAT}$'. It will be appreciated by those skilled in the art that the drawback of the prior art circuit of FIG. 1 is addressed by providing the current circuit 504 which provides the $I_{PTAT}$ invariant of any sheet resistance variation of $R_{PTAT}$.

Figure 6A:
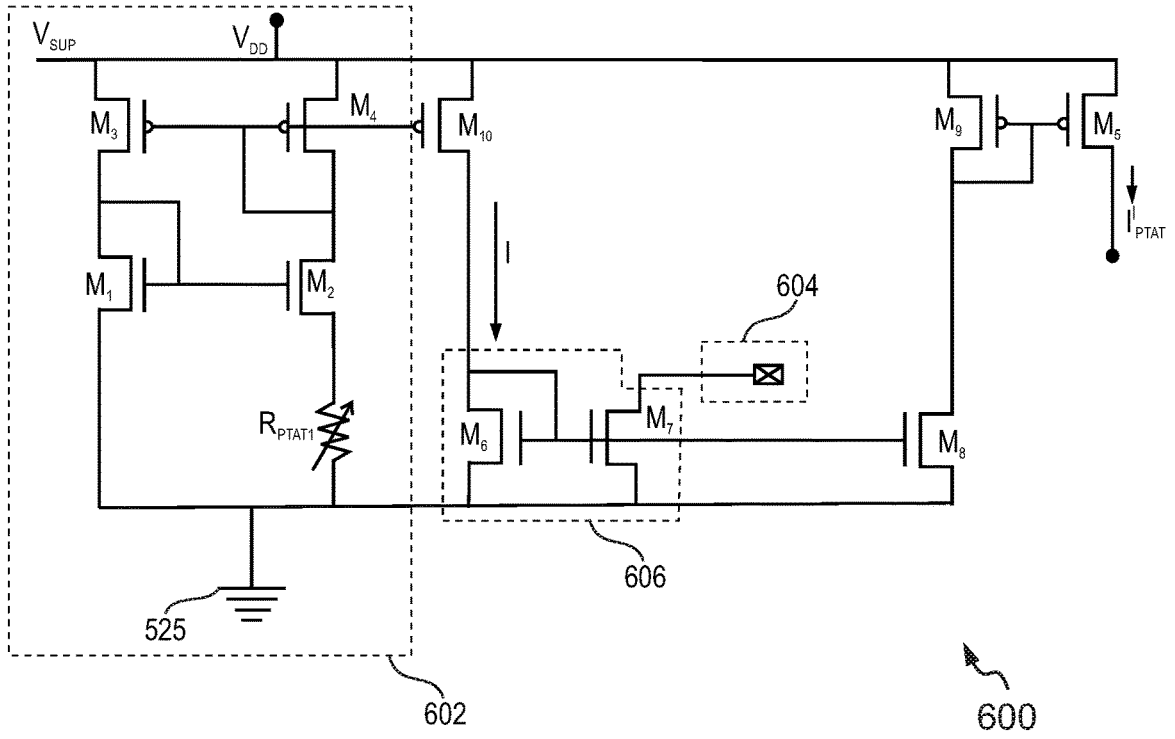
FIG. 6A illustrates a circuit diagram of a current circuit of the bandgap reference generation circuit for generating a trimmed PTAT current, in accordance with an embodiment of present disclosure.
Figure 6B:
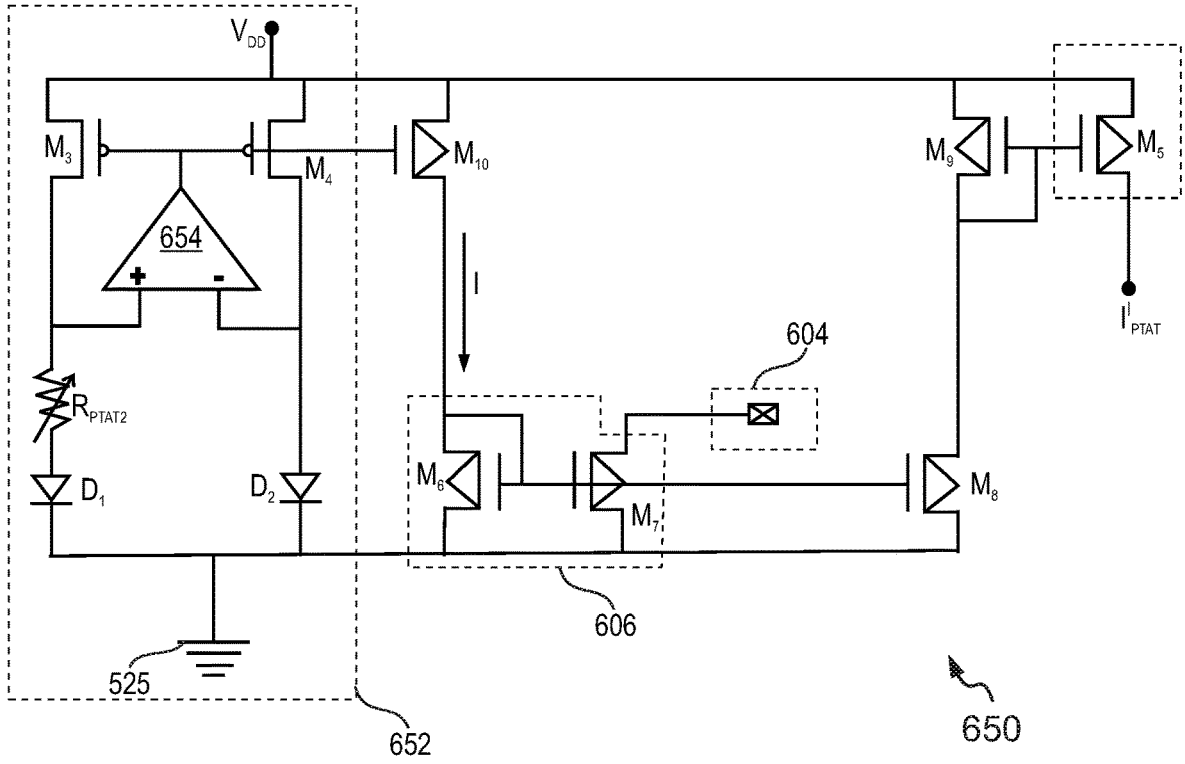
FIG. 6B illustrates a circuit diagram of a current circuit of the bandgap reference generation circuit for generating a trimmed PTAT current, in accordance with another embodiment of present disclosure.
Figure 7:
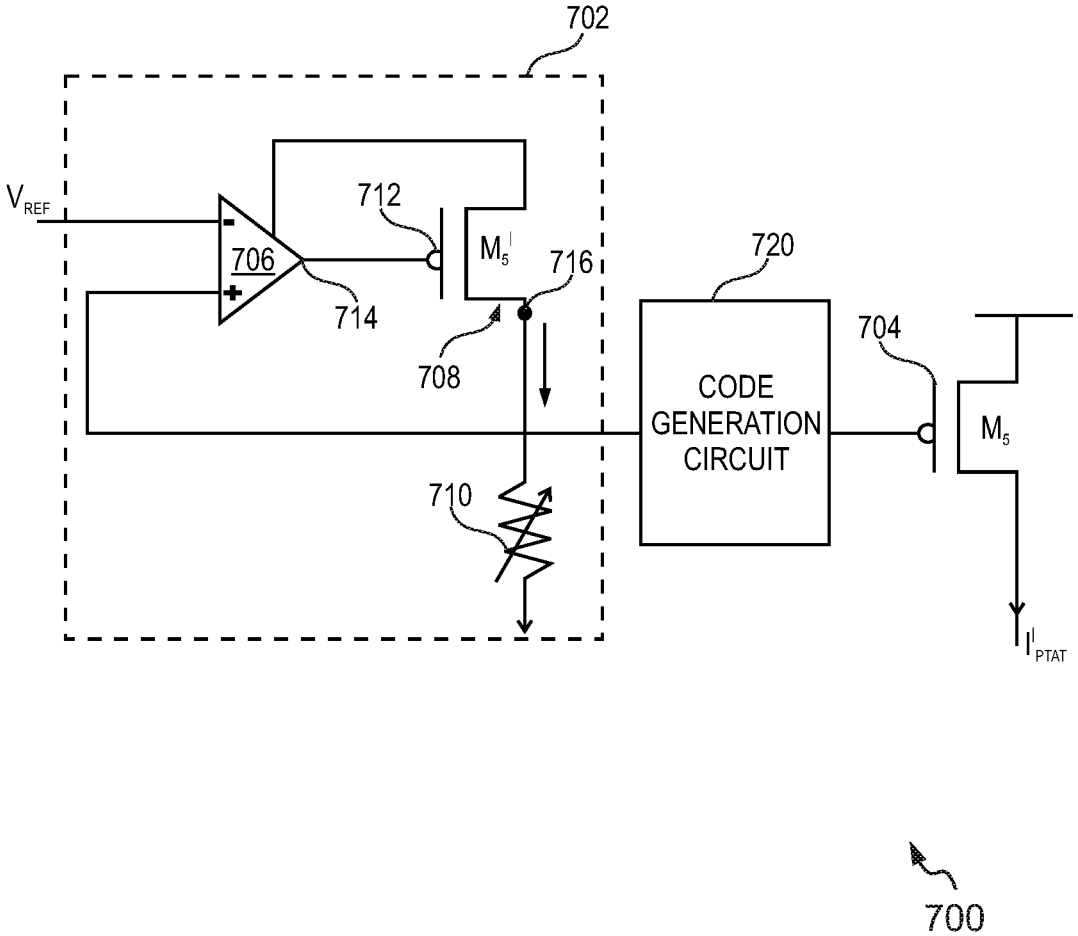
FIG. 7 illustrates a circuit diagram of a current circuit of the bandgap reference generation circuit for generating a trimmed PTAT current, in accordance with another embodiment of present disclosure.

The current circuit 504 can be configured in a variety of ways, and some example embodiments of the current circuit 504 are provided in FIGS. 6A-6B and 7.

FIG. 6A represents a circuit diagram of a current circuit 600, in accordance with an embodiment of the present disclosure. The current circuit 600 is an example of the current circuit 504. The current circuit 600 includes a PTAT loop (or a second PTAT current generation section) 602 for generating an output current (I). In the depicted embodiment, the PTAT loop 602 is formed by a second current mirror circuit comprising N-MOS transistors M1, M2 and P-MOS transistors M3 and M4 arranged in a current mirror configuration, and a second resistor. The second resistor may be an equivalent resistor of the first resistor $R_{PTAT}$ (shown in the circuit 500 of FIG. 5) and is represented as $R_{PTAT1}$ connected between source of the transistor M2 and a ground terminal 525. In an embodiment, the $R_{PTAT1}$ may be same as the $R_{PTAT}$ of FIG. 5. The PTAT loop 602 generates an output current (I) from the source of the PMOS transistor M10.

The output current (I) is sensed by a PTAT current sense circuit (or a current sensing circuit) 604. The current sensing circuit 604 may be any current sensing circuit known in the art and is shown in form of a current sensing pad for the sake of simplicity. The current sensing circuit 604 compares the output current (I) and a target PTAT current (target $I_{PTAT}$); and by adjusting the value of $R_{PTAT1}$ based on the comparison, the output current (I) is trimmed. It is noted that the $R_{PTAT1}$ may be composed of multiple resistors connected in series, from which individual resistors may be selected by respective switches (e.g., zero resistance path connected in parallel to each resistor) to operate as open or closed so as to selectively contribute to the net resistance of $R_{PTAT1}$. For instance, if the $R_{PTAT1}$ comprises N number of resistors, each with resistance 'R', and if switches of N/2 number of resistors are closed, then the net resistance of $R_{PTAT1}$ is adjusted (or trimmed) to N*R/2. In an embodiment, the output current (I) and the target $I_{PTAT}$ may be compared using a comparator circuit. In an embodiment, the current sensing circuit 604 includes a monitoring pad which monitors the output current (I), and is coupled with the comparator circuit for the comparison of the output current (I) and the target current $I_{PTAT}$. The target $I_{PTAT}$ may represent a current that is reference PTAT current component trimmed at a pre-defined temperature such as HT (e.g., 85° C.) for sheet resistance variations as well as other process variations.

The output current (I) may be trimmed in one or more ways. For instance, equivalent resistor $R_{PTAT1}$ can be trimmed by adjusting the value of $R_{PTAT1}$ to adjust the output current (I) to be equal to the target $I_{PTAT}$. Alternatively or additionally to trimming of $R_{PTAT1}$, the transistors M1, M2, M4 or M10 can be trimmed to adjust the output current (I). It is noted that the transistors can be trimmed by changing the effective width of the transistors. For instance, a transistor may be composed of 'N' number of transistors connected in parallel with respective switches, where channel width of each transistor is 'W'. In this example, a certain number of switches can be closed to offer an effective width of the transistor. The adjusted current i.e. $I'_{PTAT}$, which is equal to the target current trimmed at HT for sheet resistance variations, is fed from the transistor M5 via a third current mirror circuit formed by transistors M8, M9 and M5.

The adjusted current $I'_{PTAT}$ (i.e. trimmed $I_{PTAT}$) is fed to the CTAT element i.e. diode $D_C$ of the bandgap reference generation circuit 500.

In another embodiment, as shown in FIG. 6A, a biasing circuit 606 generates a voltage signal BIASN which is trimmed across process, e.g., sheet resistance variation of resistors for desired target $I_{PTAT}$. In some non-limiting examples, BIASN can be trimmed by trimming the equivalent resistor $R_{PTAT1}$, and/or trimming one or more of the transistors M1, M2, M4 or M10. In the current circuit 600, the current provided from the source of the PMOS transistor M5 is always the desired target $I_{PTAT}$, which is invariant of process variations such as sheet resistance changes in the resistors shown. Another variation of the current circuit 600 is represented in FIG. 6B, where the PTAT loop is designed using an operational amplifier.

Referring now to FIG. 6B, a circuit diagram of a current circuit 650 is shown, in accordance with an embodiment of the present disclosure. The current circuit 650 is an example of the current circuit 504. The current circuit 650 includes a PTAT loop (i.e. a second PTAT current generation section) 652 for generating an output current (I). In the depicted embodiment, the PTAT loop 652 is formed by an operational amplifier 654, and PMOS transistors M3 and M4 connected in a feedback configuration with each of the inverting and non-inverting inputs of the operational amplifier 654, and a second resistor such as $R_{PTAT2}$, and diodes D1 and D2. The second resistor $R_{PTAT2}$ may be an equivalent resistor of the resistor $R_{PTAT}$ shown in FIG. 5. The PTAT loop 652 generates an output current (I) as shown from the transistor M10. Further, similar to the current circuit 600 of FIG. 6A, the current circuit 650 includes the current sensing circuit 604 (representatively shown as a 'current sensing pad') and the biasing circuit 606 to trim the output current (I) such that current ($I'_{PTAT}$) through the transistor M5 is always equal to the target $I_{PTAT}$.

Present disclosure provides an additional embodiment of the current circuit 504, in which the current circuit 504 includes means for sensing variable PTAT current coming from a PTAT loop, and includes means for trimming effective width of a transistor (e.g., M5 transistor shown in FIG. 6A) for sheet resistance and other process variations at HT, which gives accurate bandgap curvature for process variations. One such embodiment is described with reference to FIG. 7, which can be used as the current circuit 504.

FIG. 7 represents a circuit diagram of a current circuit 700, in accordance with an example embodiment. The current circuit 700 is an example of the current circuit 504. The current circuit 700 includes a current sensing circuit 702 for sensing a voltage proportional to sheet resistance variation of a PTAT equivalent resistor (en equivalent resistor of $R_{PTAT}$) and for generating a sense current in response to the voltage. The current circuit 700 further includes a trimmable (or width adjustable) transistor 704 (e.g., M5 of FIGS. 6A and 6B) connected in series with the diode (e.g., the diode $D_C$ of FIG. 5) of the bandgap reference generation circuit 500. The trimmable transistor 704 is configured to be trimmed based on a trimming code to generate the trimmed PTAT current component, where the trimmed PTAT current component is equal to the target $I_{PTAT}$ which is desired PTAT current component trimmed at HT (such as but not limited to 85° C.) for sheet resistance variations as well as other process variations. The trimming code is a digital code and can be generated in response to the sense current and a pre-defined temperature such as HT. The trimming code is used to select certain number of switches (not shown) provided in the trimmable transistor 704 to adjust the effective width of the trimmable transistor 704.

The current sensing circuit 702 can be designed in multiple ways. In a non-limiting example representation shown in FIG. 7, the current sensing circuit 702 includes an amplifier 706 arranged in a negative feedback loop configuration followed by a driver element 708, wherein a first input terminal (e.g., inverting terminal represented as "-") of the amplifier 706 is connected to a precision reference voltage (e.g., see, $V_{REF}$) and the second input terminal (e.g., inverting terminal represented as "+") is connected to a third resistor 710 in the negative loop configuration. In the illustrated embodiment, the driver element 708 is an equivalent transistor (such as M5') of the trimmable transistor 704 (e.g., transistor M5 of the circuit 500), wherein a gate 712 of the driver element 708 is connected to an output 714 of the amplifier 706 and a source 716 of the driver element 708 is connected to the resistor 710. The sense current is the current through the source 716 of the driver element 708.

The current circuit 700 also includes a code generation circuit 720 for generating the trimming code in response to the sense current and the pre-defined temperature i.e. HT. The trimming code is a digital code comprising a plurality of bits. The plurality of bits is used to trim the effective width of the trimmable transistor 704 (e.g., M5) to generate the trimmed PTAT current component ($I'_{PTAT}$). In an embodiment, the code generation circuit 720 can include a comparator (not shown) that compares the sense current ($I_{SENSE}$) with a target current ($I_{TARGET}$ or 'target $I_{PTAT}$'), and generates the trimming code based on the difference of the $I_{SENSE}$ and $I_{TARGET}$. In another embodiment, the code generation circuit 720 may operate based on a look-up table which stores various trimming codes based on the values of $I_{SENSE}$ and $I_{TARGET}$.

An example representation of a look-up table is shown in the following table 1, in accordance with an example embodiment.

TABLE 1

| SHEET RESISTANCE VARIATION | $I_{SENSE}$ | M5 CODE |
|---|---|---|
| $T_{RES}$ | $I_{TARGET}$ | Default Code |
| $H_{RES}$ | $I_{SENSE} < I_{TARGET}$ | Higher code for more current |
| $L_{RES}$ | $I_{SENSE} > I_{TARGET}$ | Lower code for less current |

As provided in the Table 1, the look-up table shows parameters such as sheet resistance variation, $I_{SENSE}$ and $I_{TARGET}$ comparison, and trimming code. As shown in first row of the Table 1, when sheet resistance is equal to a normal resistance at HT, and the $I_{SENSE}$ and $I_{TARGET}$ are equal, trimming code is a default code (for example, '011'). As shown in second row, when sheet resistance is more (shown as $H_{RES}$) than the normal resistance at HT, the $I_{SENSE}$ is less than $I_{TARGET}$, trimming code can be a higher code (for example, 111). Similarly, as shown in the last row, sheet resistance is less (shown as $L_{RES}$) than the normal resistance at HT, the $I_{SENSE}$ is more than $I_{TARGET}$, trimming code can be a smaller code (for example, 000).

Referring again to FIG. 7, the trimming code provided by the code generation circuit 720 represents corresponding trim/parameter settings for the trimmable transistor 704 i.e. transistor M5. Based on the trimming code, the M5 transistor is trimmed so that the $I'_{PTAT}$ is generated which is invariant of sheet resistance variations of the $R_{PTAT}$ of the bandgap reference generation circuit 500.

As the current circuit 504 is employed in various embodiments of the bandgap reference generation circuit 500 provided by the present disclosure, it offers benefits as compared to the conventional bandgap reference generation circuit. Such benefits are in terms of greater temperature accuracy resulting from minimized drift in $V_{REF}$ that would otherwise be caused by sheet resistance variations and other process related variations in the conventional bandgap reference generation circuit of FIG. 1. A comparative analysis of the effect on temperature accuracy of the conventional bandgap reference circuit and that of the bandgap reference generation circuit 500 provided by present disclosure, is provided with reference to FIGS. 8A, 8B and 8C.

Figure 8A:
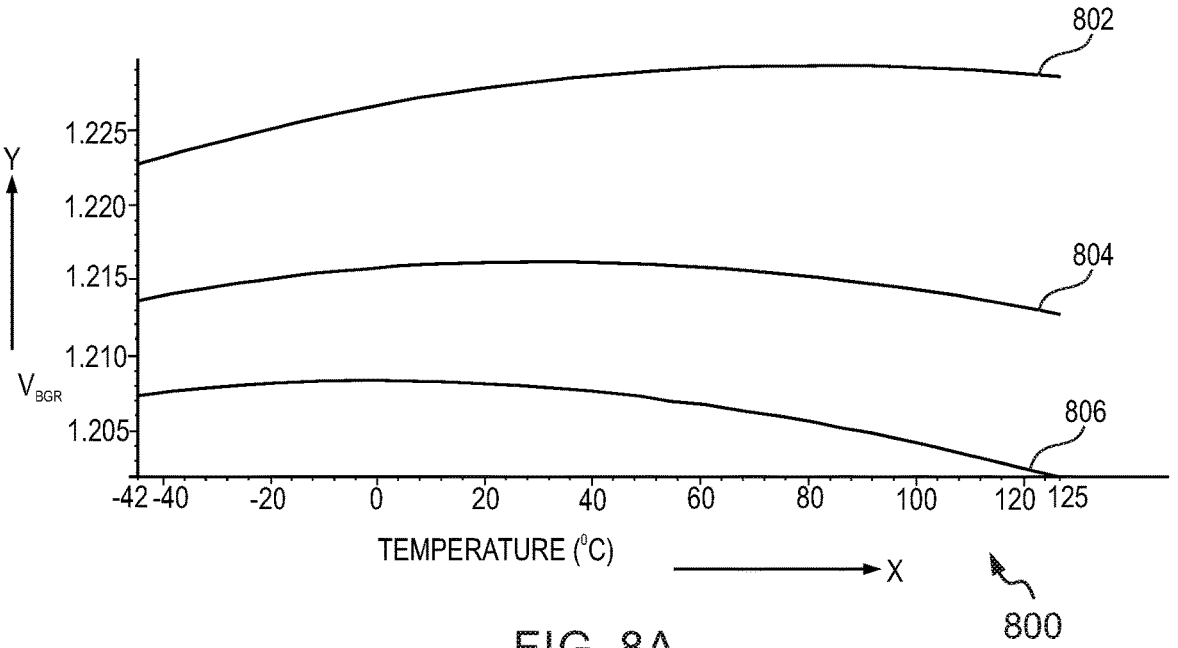
FIG. 8A illustrates a plot representing a variation of reference voltage generated by the bandgap reference generation circuit with respect to the absolute temperature of a conventional bandgap reference generation circuit of FIG. 1.

FIG. 8A shows a plot 800 of an output bandgap reference voltage ($V_{BGR}$) versus temperature for a range of −42° C. to 125° C. for the conventional bandgap reference generation circuit 100 of FIG. 1. The temperature range of −42° C. to 125° C. can be considered as a sufficient range to cover the likely extremes of operating conditions of the IC. As seen in the plot 800, there is considerable variation of $V_{BGR}$ values verses temperature when sheet resistance of the resistor (e.g., $R_{PTAT}$ shown in FIG. 1) has changed from $L_{RES}$ to $T_{RES}$ to $H_{RES}$, as shown by curves 802, 804 and 806, respectively.

Figure 8B:
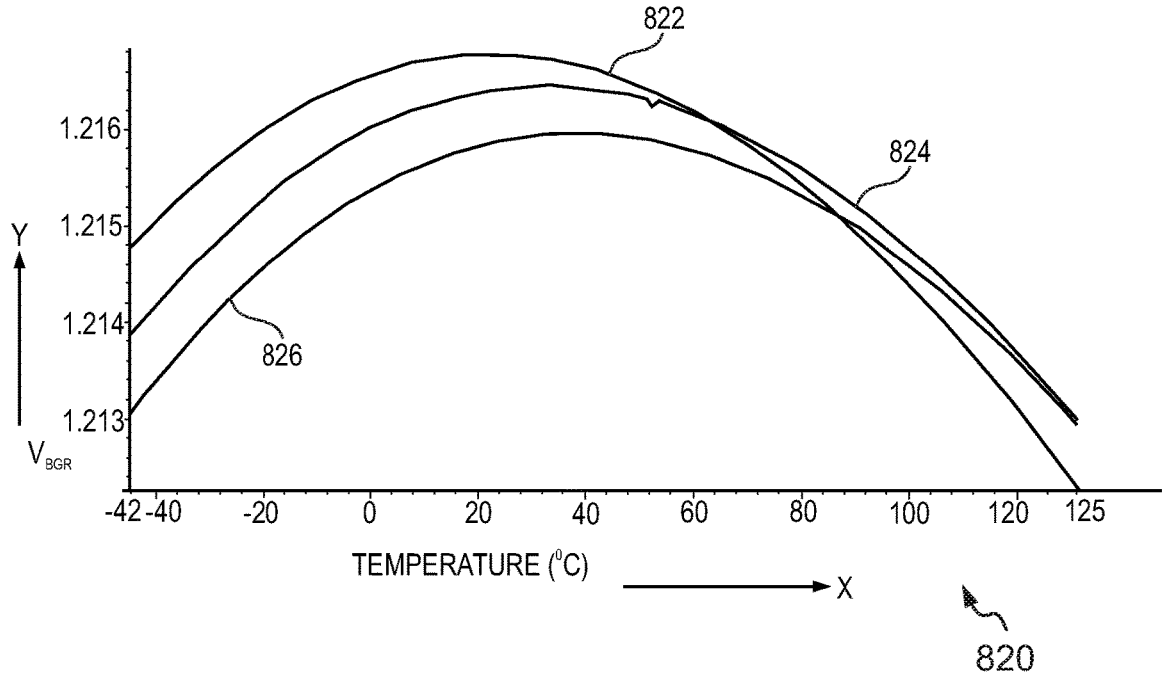
FIG. 8B is a plot representing a variation of reference voltage generated from the bandgap reference generation circuit with respect to the absolute temperature of the bandgap reference generation circuit of FIG. 5 using the current circuit of FIG. 6A or 6B.

FIG. 8B shows a plot 820 of an output bandgap reference voltage ($V_{BGR}$) versus temperature for a range of −42° C. to 125° C. for the bandgap reference generation circuit 500 of FIG. 5 employing the current circuits 600 or 650 described with reference to FIGS. 6A and 6B. As seen in the plot 820, there is considerably less variation of $V_{BGR}$ values verses temperature when sheet resistance of the resistor has changed from $L_{RES}$ to $T_{RES}$ to $H_{RES}$, as shown by curves 822, 824 and 826, respectively, in comparison with curves 802, 804 and 806, associated with the conventional bandgap reference generation circuit 100.

Figure 8C:
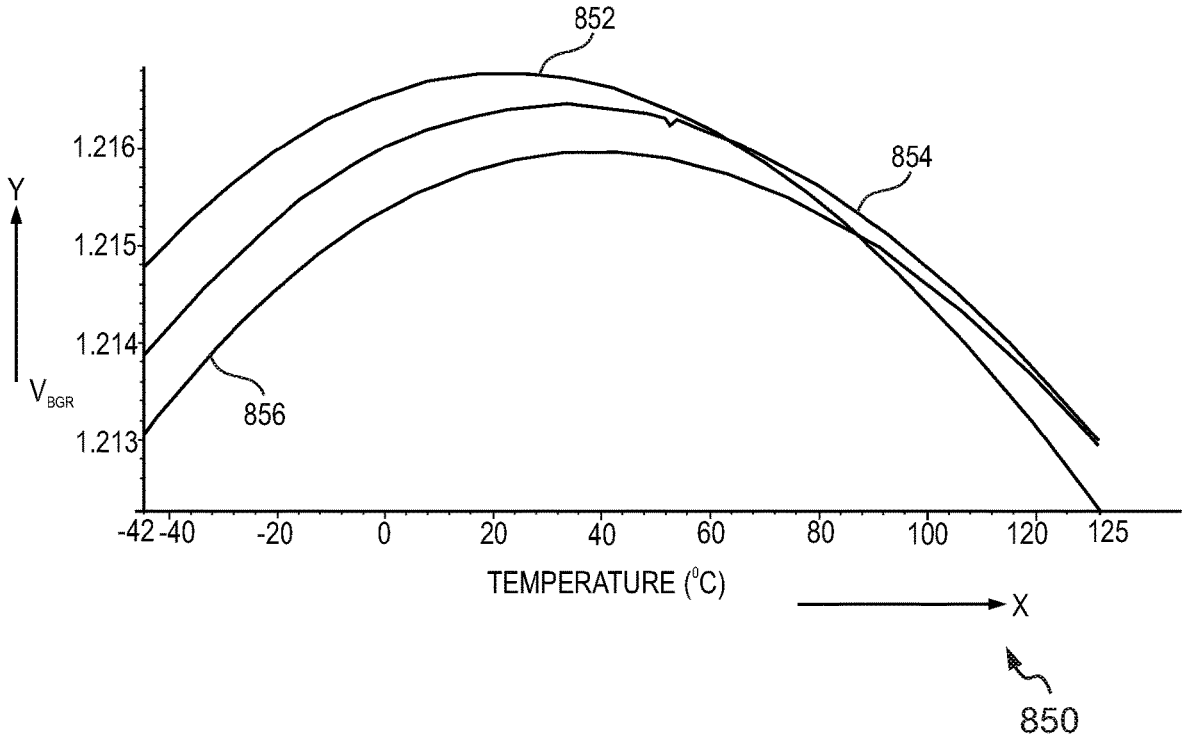
FIG. 8C is a plot representing a variation of reference voltage generated from the bandgap reference generation circuit with respect to the absolute temperature of the bandgap reference generation circuit of FIG. 5 using the current circuit of FIG. 7.

Similarly, FIG. 8C shows a plot 850 of an output bandgap reference voltage ($V_{BGR}$) versus temperature for a range of −42° C. to 125° C. for the bandgap reference generation circuits employing the current circuit 700 described with reference to FIG. 7. As seen in the plot 850, there is a considerably less variation of $V_{BGR}$ values verses temperature when sheet resistance of the resistor has changed from $L_{RES}$ to $T_{RES}$ to $H_{RES}$, as shown by curves 852, 854 and 856, respectively, in comparison with curves 802, 804 and 806, associated with the conventional bandgap reference generation circuit 100.

The following Table 2 represents impact of sheet resistance variation on temperature codes, for the conventional bandgap reference circuit 100. As shown in Table 2, effect of sheet resistance variations are shown on temperature values T1, T2 and T2, where T1 is −42° C., T2 is 85° C. and T3 is 125° C. Three representative values of sheet resistance of $R_{PTAT}$ are considered, for example, $T_{RES}$ represents an average resistance, $L_{RES}$ represents a resistance smaller than $T_{RES}$, and $H_{RES}$ represents a resistance greater than $T_{RES}$. As the sheet resistance is equal to $L_{RES}$, i.e. smaller as compared to the average sheet resistance (e.g., $T_{RES}$), the BGR curve corresponding to temperature values −42° C., 85° C. and 125° C. shifts at about −42° C., 80° C. and 119° C., respectively. Further, as the sheet resistance is equal to Hips, i.e. greater than the average sheet resistance (e.g., $T_{RES}$), the BGR curve corresponding to temperature values −42° C., 85° C. and 125° C. shifts at about −40° C., 88° C. and 129° C., respectively. Hence, an impact on accuracy of temperature is about +4° C. and −6° C. in the conventional bandgap reference circuit 100.

TABLE 2

| SHEET RESISTANCE VARIATION | T1 (−42° C.) | T2 (85° C.) | T3 (125° C.) |
|---|---|---|---|
| $L_{RES}$ | −42° C. | 80° C. | 119° C. |
| $T_{RES}$ | −41° C. | 84° C. | 125° C. |
| $H_{RES}$ | −40° C. | 88° C. | 129° C. |

The following Table 3 represents impact of sheet resistance variation on temperature codes, for the bandgap reference generating circuit including the current circuit 600 or 650. As shown in Table 3, effect of sheet resistance variations are shown on representative temperature values −42° C., 85° C. and 125° C. As the sheet resistance is equal to $L_{RES}$, i.e. smaller as compared to the average sheet resistance (e.g., $T_{RES}$), the BGR curve corresponding to temperature values −42° C., 85° C. and 125° C. shifts at about −42° C., 84° C. and 125° C., respectively. Further, as the sheet resistance is equal to Hips, i.e. greater as compared to the average sheet resistance (e.g., $T_{RES}$), the BGR curve corresponding to temperature values −42° C., 85° C. and 125° C. shifts at about −41° C., 85° C. and 125° C., respectively. Hence, an impact on accuracy of temperature is about +/−1° C. in the bandgap reference generation circuit employing the current circuit 600 or 650.

TABLE 3

| SHEET RESISTANCE VARIATION | T1 (−42° C.) | T2 (85° C.) | T3 (125° C.) |
|---|---|---|---|
| $L_{RES}$ | −42° C. | 84° C. | 125° C. |
| $T_{RES}$ | −41° C. | 84° C. | 125° C. |
| $H_{RES}$ | −41° C. | 85° C. | 125° C. |

The following Table 4 represents impact of sheet resistance variation on temperature codes, for the bandgap reference generating circuit including the current circuit 700. As shown in Table 4, effect of sheet resistance variations are shown on representative temperature values −42° C., 85° C.

and 125° C. As the sheet resistance is equal to $L_{RES}$, i.e. smaller as compared to the average sheet resistance (e.g., $T_{RES}$), the BGR curve corresponding to temperature values −42° C., 85° C. and 125° C. shifts at about −42° C., 84° C. and 125° C., respectively. Further, as the sheet resistance is equal to Hips, i.e. greater as compared to the average sheet resistance (e.g., $T_{RES}$), the BGR curve corresponding to temperature values −42° C., 85° C. and 125° C. shifts at about −41° C., 84° C. and 125° C., respectively. Hence, an impact on accuracy of temperature is about +/−1° C. in the bandgap reference generation circuit employing the current circuit 700.

TABLE 4

| SHEET RESISTANCE VARIATION | T1 (−42° C.) | T2 (85° C.) | T3 (125° C.) |
|---|---|---|---|
| $L_{RES}$ | −42° C. | 84° C. | 125° C. |
| $T_{RES}$ | −41° C. | 84° C. | 125° C. |
| $H_{RES}$ | −41° C. | 85° C. | 125° C. |

The bandgap reference generation circuit 500 provided by embodiments of the present disclosure can be used in a variety of applications including but not limited to a temperature sensing circuit which is described with reference to FIG. 9.

Figure 9:
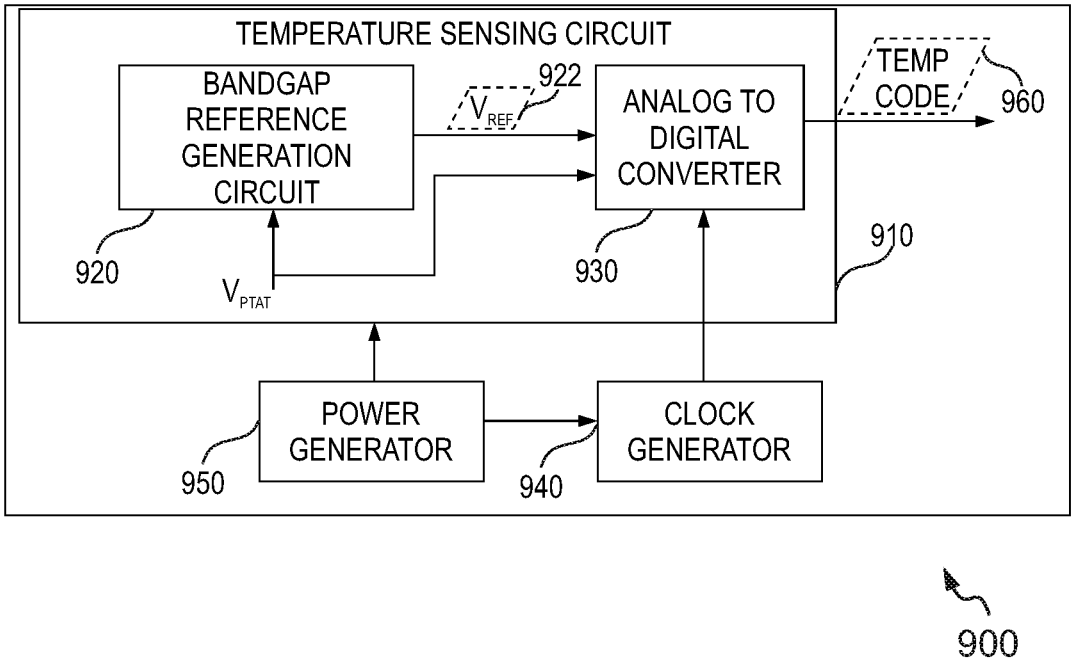
FIG. 9 illustrates a block diagram representation of a circuit including a temperature sensing circuit related to some embodiments of present disclosure.

FIG. 9 illustrates is a block diagram representation of a circuit 900, in accordance with an embodiment of present disclosure. The circuit 900 includes a temperature sensing circuit 910. The temperature sensing circuit 910 generates an output that is indicative of on-chip temperature of the circuit 900. The term "on-chip temperature" may refer to absolute temperature of the circuit 900. The temperature sensing circuit 110 may detect temperature over a sufficient range to cover the likely extremes of operating conditions of the ICs such as, including but not limited to, NAND based memory chips.

The temperature sensing circuit 910 includes a bandgap reference generation circuit 920 which generates a reference voltage signal (also referred to as a 'reference voltage' or '$V_{REF}$' or '$V_{BGR}$') 922. The $V_{REF}$ 922 is substantially independent of temperature variations of on-chip temperature of the IC 900. Also, the $V_{REF}$ 922 is substantially invariant of process related variations including, but not limited to, variation in sheet resistance of resistors (also referred to as "polyres variations"). Various embodiments of the bandgap reference generation circuit 920 (e.g., circuit 500) are already explained with reference to FIGS. 5 to 7. The temperature sensing circuit 910 also includes an analog to digital converter (ADC) 930 which receives the $V_{REF}$ 922 and a voltage signal that is proportional to the absolute temperature ($V_{PTAT}$). In some embodiments, the $V_{PTAT}$ may also be directly provided to the ADC 930 by the bandgap reference generation circuit 920.

The circuit 900 may include a variety of application specific and/or basic components for the operation of the IC 900, and only those components are shown that are relevant for the present description. For instance, the circuit 900 includes a clock generator 940 for providing a clock signal to the ADC 930, and a power generator 950 for providing power supply to the temperature sensing circuit 910 and the clock generator 940. The temperature sensing circuit 910, via the ADC 930 provides a temperature code (see, temp code 960) which may be a n-digit code representing different values of the absolute temperature.

Figure 10:
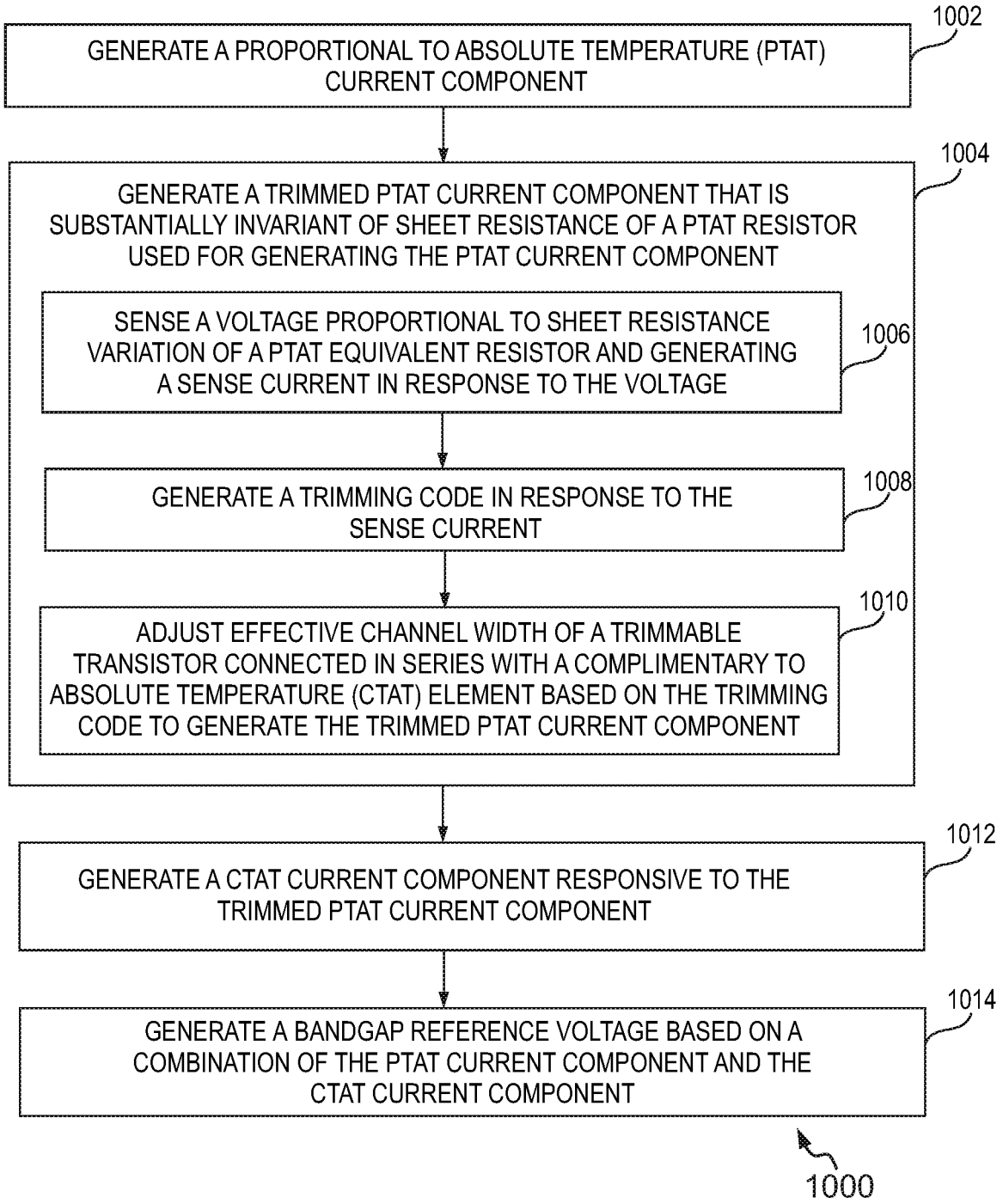
FIG. 10 is a flow chart diagram illustrating a method for generation of a bandgap reference voltage, in accordance with an embodiment of present disclosure.

Referring now to FIG. 10, a flow diagram of a method 1000 for generating a bandgap reference voltage, is shown in accordance with an example embodiment.

Operation 1002 of the method 1000 includes generating a PTAT current component ($I_{PTAT}$). The $I_{PTAT}$ can be generated by a suitable circuit such that $I_{PTAT}$ is proportional to the absolute temperature.

Operation 1004 includes generating a trimmed PTAT current component that is substantially invariant of sheet resistance of a PTAT resistor used for generating the PTAT current component. The trimmed $I_{PTAT}$ (represented as $I'_{PTAT}$) is generated by using different circuit elements than that are used for generating the $I_{PTAT}$. For example, $I_{PTAT}$ is generated using a first PTAT generation loop comprising a PTAT resistor (first resistor), whereas I'PTAT is generated using a second PTAT generation loop comprising a resistor equivalent of the PTAT resistor (i.e. second resistor), where the I'PTAT is trimmed for a pre-defined temperature for example but not limited to 85° C. Herein, $I_{PTAT}$ is trimmed current generated such that $I_{PTAT}$ is equal to a target $I_{PTAT}$, wherein the target $I_{PTAT}$ is a desired PTAT current component which is invariant of sheet resistance variations of the second resistor and thereby being invariant of the sheet resistance variations of the first resistor.

In the illustrated embodiment, the operation 1004 includes operations 1006 to 1010. Operation 1006 includes sensing a voltage proportional to sheet resistance variations of a PTAT equivalent resistor and generating a sense current in response to the voltage. Further, operation 1008 includes generating a trimming code in response to the sense current. Further, at operation 1010, effective channel width of a trimmable transistor is adjusted to generate the trimmed PTAT current component ($I'_{PTAT}$). The adjustment in the channel width of the trimmable transistor is done based on trimming code and it can be controlled by a control circuit. The trimmable transistor is connected in series with the CTAT element, and $I_{PTAT}$ is fed to the CTAT element to generate the CTAT current component, as shown by operation 1006.

Further, at operation 1012, the method 1000 includes generating the bandgap reference voltage based on a combination of the PTAT current component ($I_{PTAT}$) and the CTAT current component ($I_{CTAT}$). As $I_{PTAT}$ is positively proportional to the absolute temperature and the $I_{CTAT}$ is negatively proportional to the absolute temperature, effect of absolute temperature variations is cancelled out from the bandgap reference voltage. Further, the $I_{CTAT}$ is generated from the trimmed $I_{PTAT}$, which precludes effect of sheet resistance variations of the PTAT resistor present in the PTAT loop that generates the $I_{PTAT}$.

Figure 11:
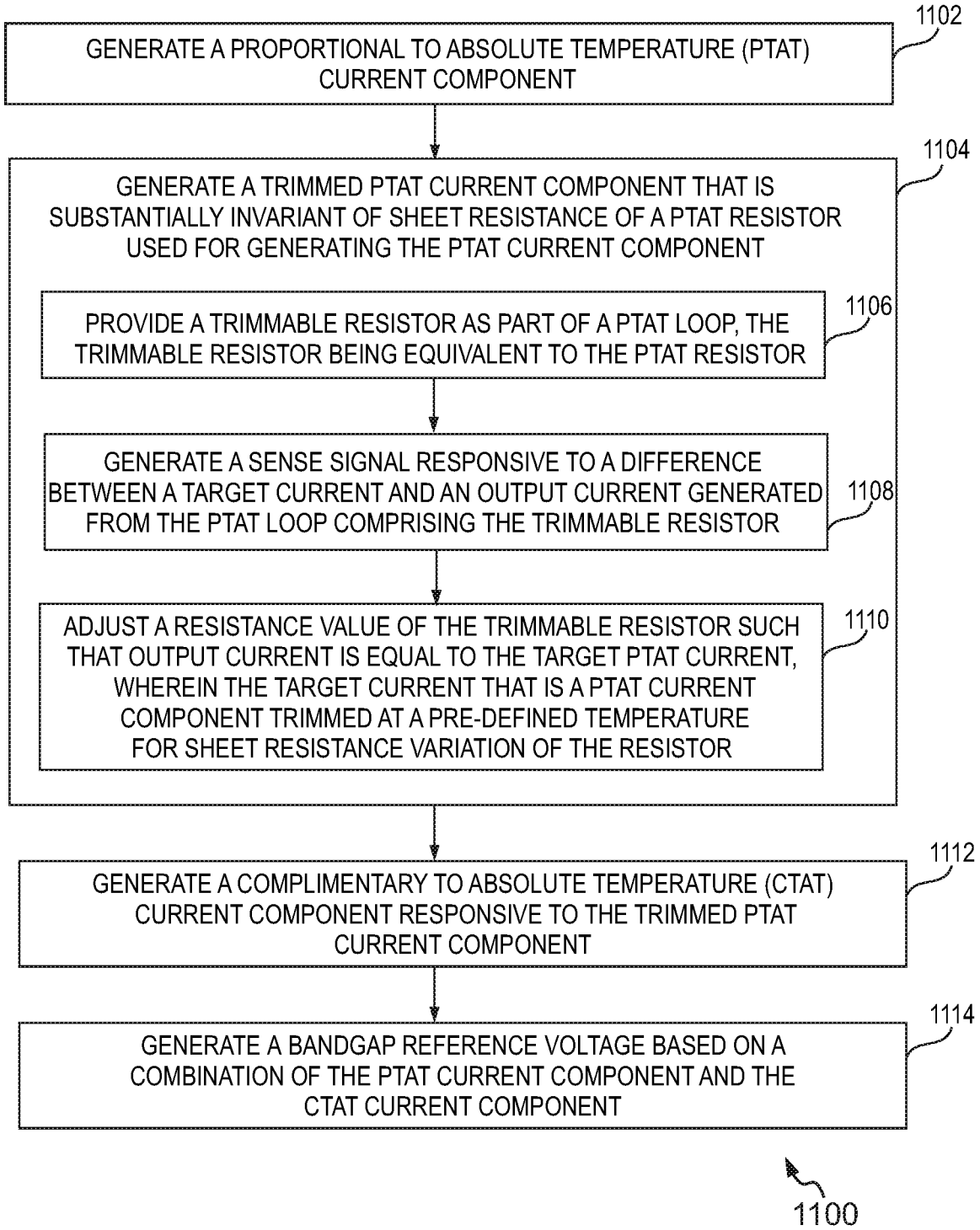
FIG. 11 is a flow chart diagram illustrating a method for generation of a bandgap reference voltage, in accordance with another embodiment of present disclosure.

Referring now to FIG. 11, a flow diagram of a method 1100 for generating a bandgap reference voltage, is shown in accordance with another example embodiment.

Operation 1102 of the method 1100 includes generating a PTAT current component ($I_{PTAT}$). The $I_{PTAT}$ can be generated by a suitable circuit such that $I_{PTAT}$ is proportional to the absolute temperature.

Operation 1104 includes generating a trimmed PTAT current component ($I'_{PTAT}$) that is substantially invariant of sheet resistance of a PTAT resistor used for generating the PTAT current component ($I_{PTAT}$). In this illustrated embodiment, the operation 1104 includes operations 1106 to 1110. Operation 1106 includes providing a trimmable resistor as part of a PTAT loop, the trimmable resistor being equivalent to the PTAT resistor. The PTAT loop (e.g., second PTAT loop) is a different PTAT loop than that of used for generating the $I_{PTAT}$ (e.g., a first PTAT loop used for generating $I_{PTAT}$). The second PTAT loop generates an output current i.e. a PTAT current. Operation 1108 includes generating a sense signal responsive to a difference between a target current and an output current generated from the PTAT loop comprising the trimmable resistor. Further, operation 1110 includes adjusting a resistance value of the trimmable resistor such that output current is equal to the target PTAT current. The target current is a PTAT current component trimmed at a pre-defined temperature (e.g., HT) for sheet resistance variation of the PTAT resistor.

Further, at operation 1112, the method 1100 includes generating the bandgap reference voltage based on a combination of the PTAT current component ($I_{PTAT}$) and the CTAT current component ($I_{PTAT}$).

The methods 1000 and 1100 can be performed by bandgap reference generation circuits including but not limited to bandgap reference generation circuits shown and described with reference to various embodiments of the present disclosure.

Various embodiments of the present disclosure offer multiple advantages and technical effects. For instance, the bandgap reference generation circuit provides the $V_{BGR}$ which is invariant of any process changes including but not limited to changes in sheet resistance of resistors used for generation of $I_{PTAT}$ in the bandgap reference generation circuit. Further, the present disclosure provides various examples of the current circuit which trims the PTAT current component provided by a separate PTAT loop of the bandgap reference generation circuit, such that the trimming is performed only at the HT, and not at the LT. Hence, the applications such as temperature sensing circuit using the bandgap reference generation circuit provided herein, are highly accurate based on the bandgap architecture chosen with one temperature trim only. It also saves design and test time. Further, the design of bandgap reference generation circuit can be used for any IPs with power constraints. As described earlier, LT trimming disturbs the HT trim advantages as well as impacts the accuracy, and such drawbacks are avoided by the teachings of the various embodiments of the present disclosure.

Although the present technology has been described with reference to specific exemplary embodiments, it is noted that various modifications and changes may be made to these embodiments without departing from the broad spirit and scope of the present technology. For example, the various systems, modules, etc., described herein may be enabled and operated using hardware circuitry (e.g., complementary metal oxide semiconductor (CMOS) based logic circuitry), firmware, software and/or any combination of hardware, firmware, and/or software (e.g., embodied in a machine readable medium). For example, the various modules and methods may be embodied using transistors, logic gates, and electrical circuits (e.g., application specific integrated circuit (ASIC) circuitry and/or in Digital Signal Processor (DSP) circuitry).

A circuit, as used herein, comprises a set of one or more electrical and/or electronic components providing one or more pathways for electrical current. In certain embodiments, a circuit may include a return pathway for electrical current, so that the circuit is a closed loop. In another embodiment, however, a set of components that does not include a return pathway for electrical current may be referred to as a circuit (e.g., an open loop). For example, an integrated circuit may be referred to as a circuit regardless of whether the integrated circuit is coupled to ground (as a return pathway for electrical current) or not. In various embodiments, a circuit may include a portion of an integrated circuit, an integrated circuit, a set of integrated circuits, a set of non-integrated electrical and/or electrical components with or without integrated circuit devices, or the like. In one embodiment, a circuit may include custom VLSI circuits, gate arrays, logic circuits, or other integrated circuits; off-the-shelf semiconductors such as logic chips, transistors, or other discrete devices; and/or other mechanical or electrical devices. A circuit may also be implemented as a synthesized circuit in a programmable hardware device such as field programmable gate array, programmable array logic, programmable logic device, or the like (e.g., as firmware, a netlist, or the like). A circuit may comprise one or more silicon integrated circuit devices (e.g., chips, die, die planes, packages) or other discrete electrical devices, in electrical communication with one or more other components through electrical lines of a printed circuit board (PCB) or the like. Each of the modules described herein, in certain embodiments, may be embodied by or implemented as a circuit.

Also, techniques, subsystems and methods described and illustrated in the various embodiments as discrete or separate may be combined or integrated with other systems, modules, techniques, or methods without departing from the scope of the present technology. Other items shown or discussed as directly coupled or connected with one another, or as directly communicating with each other, may be communicatively associated through some interface or device, such that the items may no longer be considered directly coupled or connected with one another, or directly communicating with each other, but may still be indirectly communicatively associated and in communication, whether electrically, mechanically, or otherwise, with one another. Other examples of changes, substitutions, and alterations ascertainable by one skilled in the art, upon studying the exemplary embodiments disclosed herein, may be made without departing from the spirit and scope of the present technology.

It should be noted that reference throughout this specification to features, advantages, or similar language does not imply that all of the features and advantages should be or are in any single embodiment. Rather, language referring to the features and advantages may be understood to mean that a specific feature, advantage, or characteristic described in connection with an embodiment may be included in at least one embodiment of the present technology. Thus, discussions of the features and advantages, and similar language, throughout this specification may, but do not necessarily, refer to the same embodiment. Various embodiments of the present disclosure, as discussed above, may be practiced with steps and/or operations in a different order, and/or with hardware elements in configurations which are different than those which are disclosed. Therefore, although the technology has been described based upon these exemplary embodiments, it is noted that certain modifications, variations, and alternative constructions may be apparent and well within the spirit and scope of the technology.

Although various exemplary embodiments of the present technology are described herein in a language specific to structural features and/or methodological acts, the subject matter defined in the appended claims is not necessarily limited to the specific features or acts described above. Rather, the specific features and acts described above are disclosed as exemplary forms of implementing the claims.

The foregoing detailed description of the invention has been presented for purposes of illustration and description. It is not intended to be exhaustive or to limit the invention to the precise form disclosed. Many modifications and variations are possible in light of the above teaching. The described embodiments were chosen to best explain the principles of the invention and its practical application, to thereby enable others skilled in the art to best utilize the invention in various embodiments and with various modifications as are suited to the particular use contemplated. It is intended that the scope of the invention be defined by the claims appended hereto.

What is claimed is:

1. A bandgap reference generation circuit, comprising:

a first proportional to absolute temperature (PTAT) current generation section for generating a PTAT current component;

a current circuit configured to generate a trimmed PTAT current component, wherein the trimmed PTAT current component is substantially invariant of sheet resistance of at least one resistor in the current circuit; and a complementary to absolute temperature (CTAT) current generation section connected to the current circuit for generating a CTAT current component in response to the trimmed PTAT current component, wherein a combination of the PTAT current component and the CTAT current component generates a bandgap reference voltage at an output node of the bandgap reference generation circuit.

2. The bandgap reference generation circuit of claim 1, wherein the current circuit comprises:

a second PTAT current generation section for generating an output current;

a PTAT current sense circuit for generating a sense signal based on a comparison of the output current and a target PTAT current; and a bias circuit connected to the second PTAT current generation section and the PTAT current sense circuit for providing a bias voltage trimmed at a pre-defined temperature based on the sense signal, wherein the bias voltage is configured to bias at least one transistor of the second PTAT current generation section to generate the output current equal to the target PTAT current, the target PTAT current being equal to the trimmed PTAT current component.

3. The bandgap reference generation circuit of claim 2, wherein the second PTAT current generation section comprises a PTAT loop comprising a second current mirror circuit and a PTAT equivalent resistor, and wherein the temperature sensing circuit further comprises a third current mirror circuit for feeding the trimmed PTAT current component to a diode of the CTAT current generation section for generating the CTAT current component.

4. The bandgap reference generation circuit of claim 3, wherein the PTAT equivalent resistor is a trimmable resistor and the bias voltage is trimmed in response to at least one of: trimming of the PTAT equivalent resistor; and trimming of one or more transistors of the second current mirror circuit.

5. The bandgap reference generation circuit of claim 3, wherein the second current mirror circuit comprises an operational amplifier, and wherein the PTAT equivalent resistor is connected to a non-inverting terminal of the operational amplifier.

6. The bandgap reference generation circuit of claim 1, wherein the current circuit comprises:

a PTAT loop comprising a trimmable resistor for generating an output current; and a PTAT current sense circuit for generating a sense signal in response to a comparison of the output current and a target PTAT current, wherein the trimmable resistor is configured to be trimmed in response to the sense signal to generate the output current as equal to the target PTAT current, wherein the target PTAT current is substantially equal to the trimmed PTAT current component.

7. The bandgap reference generation circuit of claim 1, wherein the current circuit comprises:

a current sensing circuit for sensing a voltage proportional to sheet resistance variation of a third resistor and generating a sense current in response to the voltage; and a trimmable transistor connected in series with the diode, the trimmable transistor configured to be trimmed based on a trimming code to generate the trimmed PTAT current component, the trimming code generated in response to the sense current and a pre-defined temperature.

8. The bandgap reference generation circuit of claim 7, wherein the current circuit further comprises a code generation circuit for generating the trimming code in response to the sense current and the pre-defined temperature, wherein the trimming code is a digital code comprising a plurality of bits, and wherein the plurality of bits is configured to trim the trimmable transistor to generate the trimmed PTAT current component.

9. The bandgap reference generation circuit of claim 7, wherein the current sensing circuit comprises:

an amplifier arranged in a negative feedback loop configuration followed by a driver element, wherein a first input terminal of the amplifier is connected to a precision reference voltage and a second input terminal is connected to a third resistor in a negative loop configuration, wherein the driver element is an equivalent transistor of the trimmable transistor, wherein a gate of the driver element is connected to an output of the amplifier and a source of the driver element is connected to the third resistor, and wherein the sense current is a current through the source of the driver element.

10. The bandgap reference generation circuit of claim 1, wherein the bandgap reference generation circuit is comprised in a temperature sensing circuit, wherein the temperature sensing circuit comprises an analog to digital converter (ADC) circuit configured to receive the bandgap reference voltage from the output node and a PTAT voltage to generate an output indicative of the on-chip temperature.

11. The current circuit of claim 10, further comprising:

a current sensing circuit for sensing a voltage proportional to sheet resistance variation of a third resistor and generating a sense current in response to the voltage; and a trimmable transistor connected in series with a first diode, the trimmable transistor configured to be trimmed based on a trimming code to generate the trimmed PTAT current component, the trimming code generated in response to the sense current and a pre-defined temperature.

12. The current circuit of claim 11, further comprising:

a code generation circuit for generating the trimming code in response to the sense current and the pre-defined temperature, wherein the trimming code is a digital code comprising a plurality of bits, wherein the plurality of bits is configured to trim the trimmable transistor to generate the trimmed PTAT current component, and wherein the current sensing circuit comprises an amplifier arranged in a negative feedback loop configuration followed by a driver element, wherein a first input terminal of the amplifier is connected to a precision reference voltage and the second input terminal is connected to the third resistor in the negative loop configuration, wherein the driver element is an equivalent transistor of the trimmable transistor, wherein a gate of the driver element is connected to an output of the amplifier and a source of the driver element is connected to the third resistor, and wherein the sense current is a current flowing through the source of the driver element.

13. A current circuit for use in a bandgap reference generation circuit, the current circuit comprising:

a proportional to absolute temperature (PTAT) current generation section for generating a trimmed PTAT current component, wherein the trimmed PTAT current component is substantially invariant of sheet resistance of a PTAT resistor, the PTAT current generation section being different than another PTAT current generation section used for generating a PTAT current component in the bandgap reference generation circuit, wherein the trimmed PTAT current component is used to generate a complementary to absolute temperature (CTAT) current component in the bandgap reference generation circuit.

14. The current circuit of claim 13, wherein the PTAT current generation section comprises a current mirror circuit and a PTAT equivalent resistor for generating an output current, and wherein the current circuit further comprises:

a PTAT current sense circuit for generating a sense signal based on a comparison of the output current and a target PTAT current; and a bias circuit connected to the PTAT current generation section and the PTAT current sense circuit for providing a bias voltage trimmed at a pre-defined temperature based on the sense signal, wherein the bias voltage is configured to bias at least one transistor of the PTAT current generation section to generate the output current equal to the target PTAT current, the target PTAT current being equal to the trimmed PTAT current component.

15. The current circuit of claim 14, wherein the bias voltage is trimmed in response to at least one of: trimming of the trimmable resistor; and trimming of one or more transistors of the current mirror circuit.

16. The current circuit of claim 14, wherein the current mirror circuit comprises an operational amplifier, and wherein the PTAT equivalent resistor is connected to a non-inverting terminal of the operational amplifier.

17. The current circuit of claim 13, further comprising:

a PTAT loop comprising a trimmable resistor for generating an output current; and a PTAT current sense circuit for generating a sense signal in response to a comparison of the output current and a target PTAT current, wherein the trimmable resistor is configured to be trimmed in response to the sense signal to generate the output current as equal to the target PTAT current, wherein the target PTAT current is substantially equal to the trimmed PTAT current component.

18. A method of generating a bandgap reference voltage, comprising:

generating a proportional to absolute temperature (PTAT) current component;

generating a trimmed PTAT current component that is substantially invariant of sheet resistance of a PTAT resistor used for generating the PTAT current component;

generating a complementary to absolute temperature (CTAT) current component in response to providing the trimmed PTAT current component to a CTAT element; and generating the bandgap reference voltage based on a combination of the PTAT current component and the CTAT current component.

19. The method as claimed in claim 18, wherein generating the trimmed PTAT current component comprises:

sensing a voltage proportional to sheet resistance variation of a PTAT equivalent resistor and generating a sense current in response to the voltage;

generating a trimming code in response to the sense current;

adjusting effective channel width of a trimmable transistor connected in series with a CTAT element based on the trimming code to generate the trimmed PTAT current component.

20. The method as claimed in claim 18, wherein generating the trimmed PTAT current component comprises:

providing a trimmable resistor as part of a PTAT loop, the trimmable resistor being equivalent to the PTAT resistor;

generating a sense signal responsive to a difference between a target current and an output current generated from the PTAT loop comprising the trimmable resistor; and adjusting a resistance value of the trimmable resistor such that output current is equal to the target PTAT current, wherein the target current that is a PTAT current component trimmed at a pre-defined temperature for sheet resistance variation of the PTAT resistor.

* * * * *